US006217194B1

(12) United States Patent
Huang

(10) Patent No.: US 6,217,194 B1
(45) Date of Patent: Apr. 17, 2001

(54) STRUCTURE OF A FITTING LIGHT

(75) Inventor: Peter K. H. Huang, Taipei (TW)

(73) Assignee: Shining Blick Enterprises Co., Ltd., Taipei (TW)

( * ) Notice: Subject to any disclaimer, the term of this patent is extended or adjusted under 35 U.S.C. 154(b) by 0 days.

(21) Appl. No.: 09/579,469

(22) Filed: May 26, 2000

(51) Int. Cl.[7] ..... F21V 21/00
(52) U.S. Cl. ..... 362/249; 362/252; 362/806
(58) Field of Search ..... 362/227, 240, 362/249, 252, 806, 255, 250, 418, 808

(56) References Cited

U.S. PATENT DOCUMENTS 4,177,503 * 12/1979 Auquetin ..... 362/252
4,607,317 * 8/1986 Lin ..... 362/806
4,812,956 * 3/1989 Chen ..... 362/249

* cited by examiner

*Primary Examiner*—Y. Quach
(74) *Attorney, Agent, or Firm*—Dougherty & Troxell

(57) ABSTRACT

An improved structure of a fitting light comprising a transparent lamp pipe integrally formed and covered with a coating, wherein, a plurality of power conductors including a common power conductor and a plurality of individual power conductors are positioned in the lamp pipe synchronically when in shaping the latter, several axial elongated grooves in same number as that of lamp strings used in the lamp pipe are disposed on the lamp pipe and are equidistantly apart from one another to each receive a lamp string; the power conductors are disposed to make every two of the power conductors including the common power conductor and one of the individual power conductors contain therebetween an axial elongated groove. The lamp pipe having been placed therein the lamp strings is shaped to have a positioning layer with a minimal diameter formed on the external periphery thereof, and to make a transparent coating of a minimal diameter cover thereon.

4 Claims, 6 Drawing Sheets

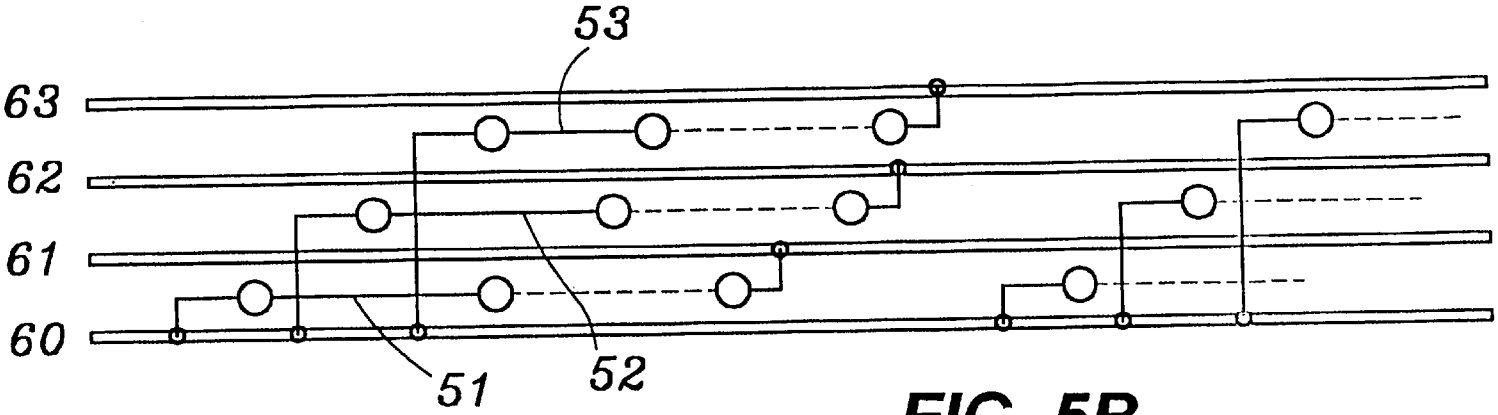
FIG. 5B
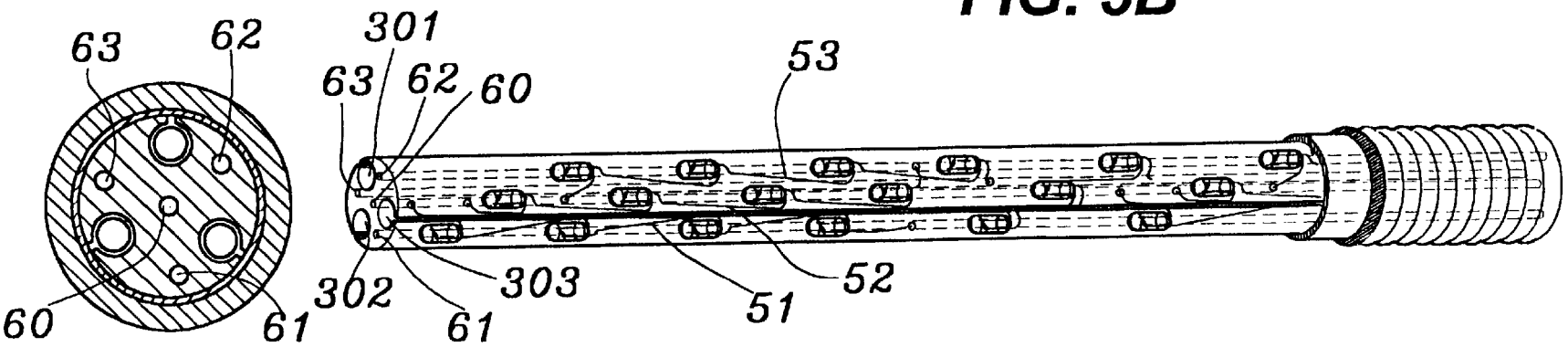
FIG. 5
FIG. 5A

STRUCTURE OF A FITTING LIGHT

BACKGROUND OF THE INVENTION

1. Field of the Invention

The present invention is related to an improved structure of a fitting light, and especially to a connecting structure for multiple internal lamp strings in such a fitting light, the structure meets the specifications for safety. When the fitting light is provided with multiple lamp strings of any of various lengths, the whole external diameter of the fitting light can be effectively reduced.

2. Description of the Prior Art

A fitting light or lighting rope system includes more than one lamp string having light emitting or flashing function in a flexible and transparent pipe when a circuit for the lamp string activates it. Such flexible fitting light can be hung in the shape of a surface to be decorated (such as a wall surface of a building), and can also be manufactured as a roll to be cut to get a desired length.

The basic structure of such pipe like fitting light includes a necessary power conductor and a lot of lamp bulbs for forming the lamp strings. In the existing fitting lights, those having a lot of lamp bulbs positioned in a pipe include two kinds, one has a lot of radial holes alternately provided on the pipe, the other has a plurality of axial grooves provided on the pipe. The power conductors for connecting the lamp strings are integrally formed in position with the transparent pipe (generally of PVC material).

In the above state structure of fitting light having a lot of radial holes for positioning the lamp bulbs, as shown in FIG. 1, a plurality of power conductors 11, 12, 13 can be simultaneously positioned in a transparent pipe 10 when the latter is made of PVC material. Such structure has two lamp strings in the pipe; hence it contains a common power conductor 11 and two connecting conductors 12, 13. The pipe having the power conductors positioned is formed to have a lot of radial holes. This kind of product has in the first place a larger radial hole to allow inserting in of a lamp bulb 14 of each lamp string, then two smaller radial holes are provided next to this hole to allow inserting in of two connecting devices 15, and again a larger radial hole and then two other smaller radial holes are provided, and so forth. In this way, the lamp strings having a lot of lamp bulbs 14 can be placed into the pipe in sequence. Such conventional structure of fitting light is troublesome to assemble by having one or more than one lamp strings placed in through the radial holes not only this, the power conductors 11, 12, 13 must evade the radial holes for the latter to extend directly to the center of the pipe. This makes extreme closing of the power conductors 12, 13 to the external periphery 16 of the transparent pipe 10. Even further, when the transparent pipe 10 includes three or more than three lamp strings, most of the power conductors thereof are not convenient for desposition. The power conductors too close to the external periphery 16 of the transparent pipe 10 will be pierced to break and expose at the joints of every two fitting lights which must have special lengths by cutting before connecting. Therefore, the whole lengthy fitting light is inherently dangerous; the optional connecting work with fitting lights of desired lengths cut from the rolls often does not meet the requirement of safety in some countries with strict specifications, some times these countries do not permit using such cut products in the markets.

As to the fitting light having a lot of axial grooves to position the lamp string, as shown in FIG. 2, an elongated groove 101 is provided axially on a transparent pipe 100 for placing therein a lamp string with a lot of lamp bulbs 102. A plurality of power conductors 103, 104, 105 are all disposed on one side of the elongated groove 101. Such a conventional fitting light structure similarly is disadvantageous in that it must have a plurality of lamp strings assembled in a single elongated groove 101, and that the power conductors 104, 105 are too close to the external periphery of the transparent pipe 100, thereby it is inferior in safety. And by virtue that the power conductors are all disposed on one side of the elongated groove 101, the diameter of the whole fitting light will be increased, thus its function is badly influenced and cost is increased.

SUMMARY OF THE INVENTION

The object of the present invention is to provide an improved structure for a fitting light. The transparent pipe thereof is made with a plurality of axial elongated grooves, shaped to receive the given amount of lamp strings, a common power conductor and a plurality of individual power conductors The common power conductor and every one of the individual power conductors are contained in one of the elongated grooves in the transparent pipe in order that every lamp string is disposed in one of the elongated grooves. Such a semi-finished product then is given a safe positioning layer with a minimal diameter, and then is covered with a coat with a minimal thickness. In this way, an improved structure for a fitting light with larger amount of internal lamp strings occupying smaller external diameter is formed which is more convenient for assembling and meets a higher safety specification.

The present invention will be apparent in its novelty and features after reading the detailed description of the preferred embodiment thereof in reference to the accompanying drawings.

BRIEF DESCRIPTION OF THE DRAWINGS

FIG. 4A is a sectional view thereof; While

FIG. 5 is another structural schematic view showing the present invention with three lamp strings;

FIG. 6A is a sectional view thereof; While

DETAILED DESCRIPTION OF THE PREFERRED EMBODIMENT

Figure 1:
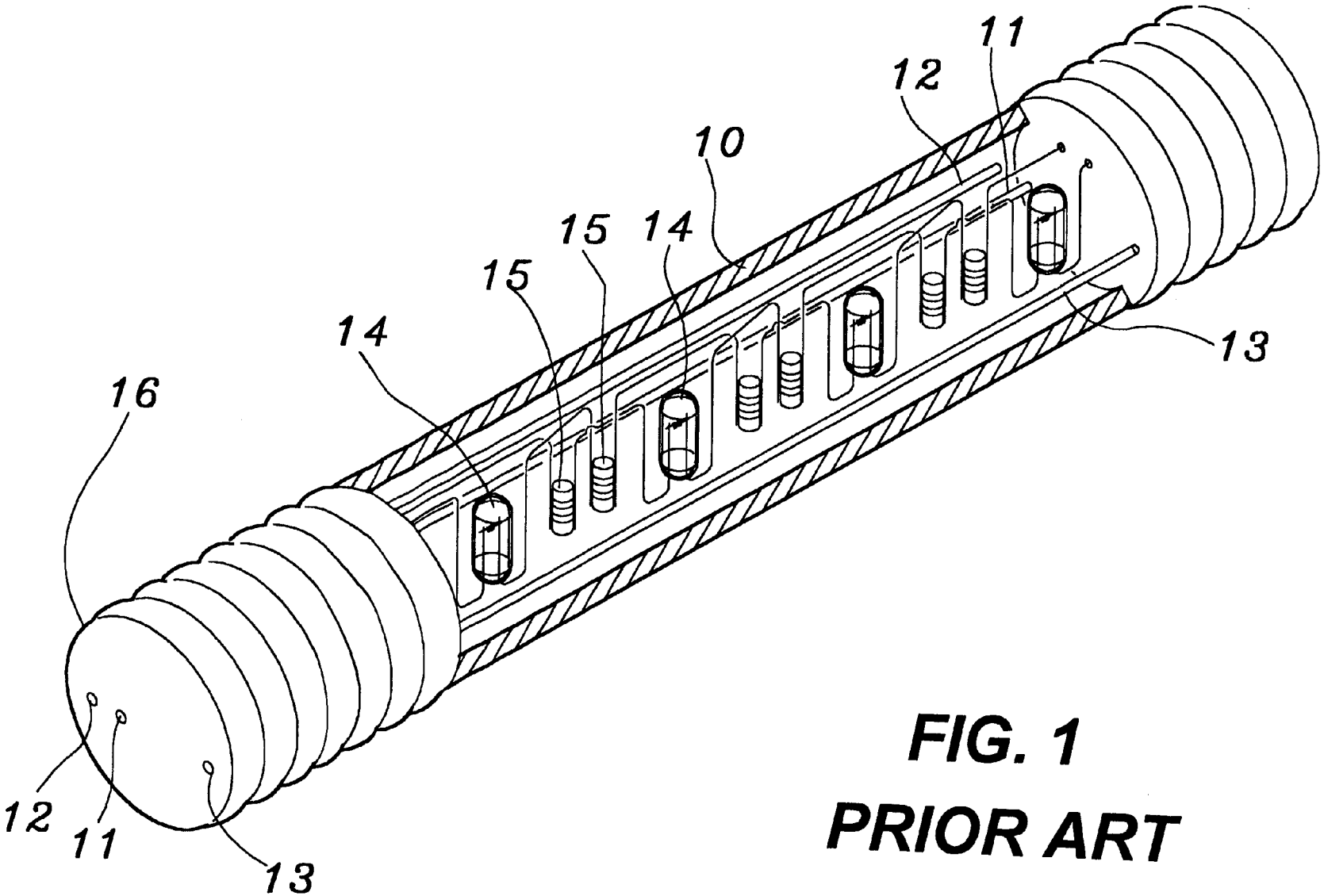
FIG. 1 PRIOR ART
FIG. 1 is a perspective view showing the structure of a conventional fitting light.
Figure 2:
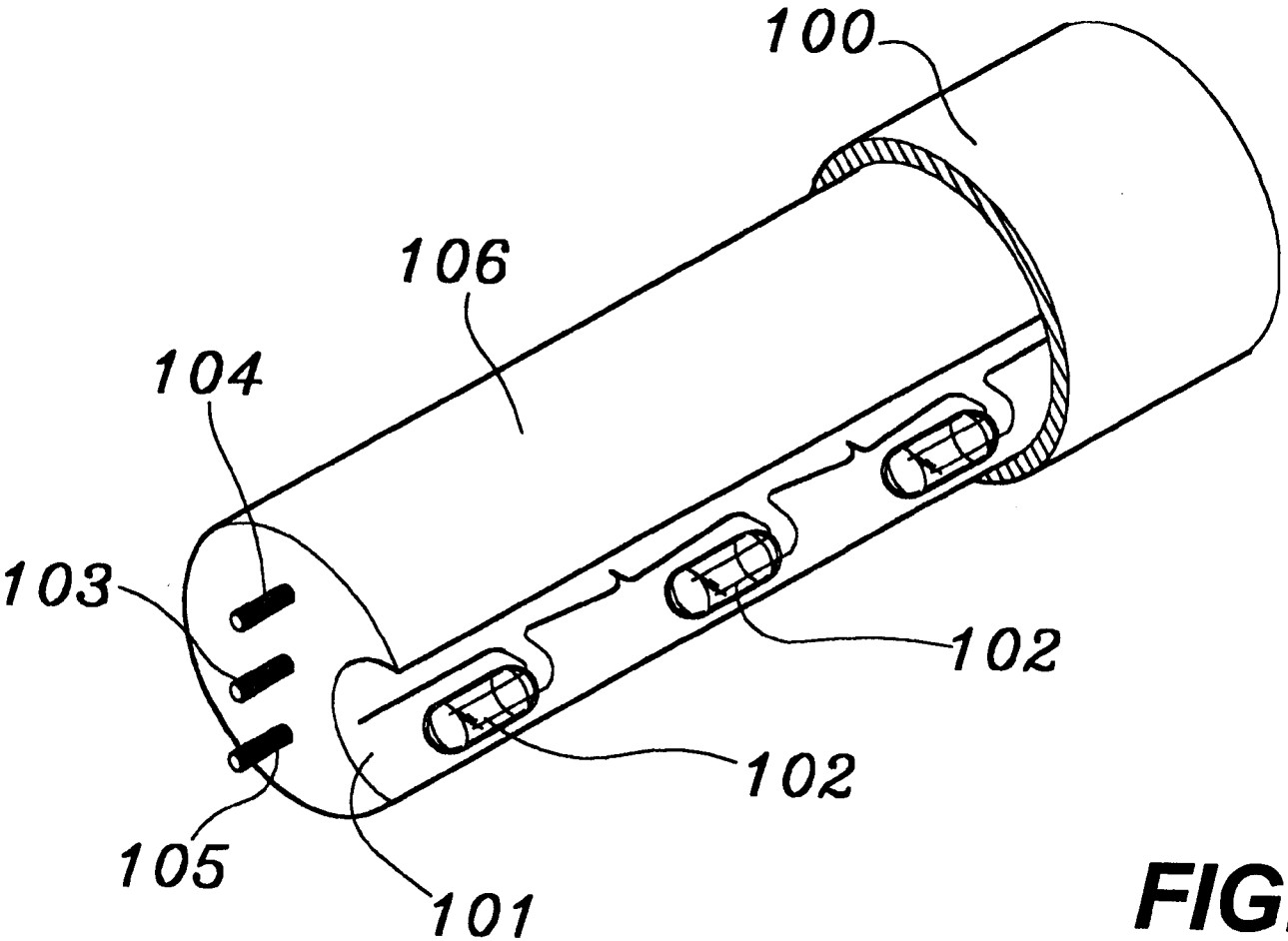
FIG. 2 PRIOR ART
FIG. 2 is a perspective view showing the structure of another conventional fitting light.
Figure 3:
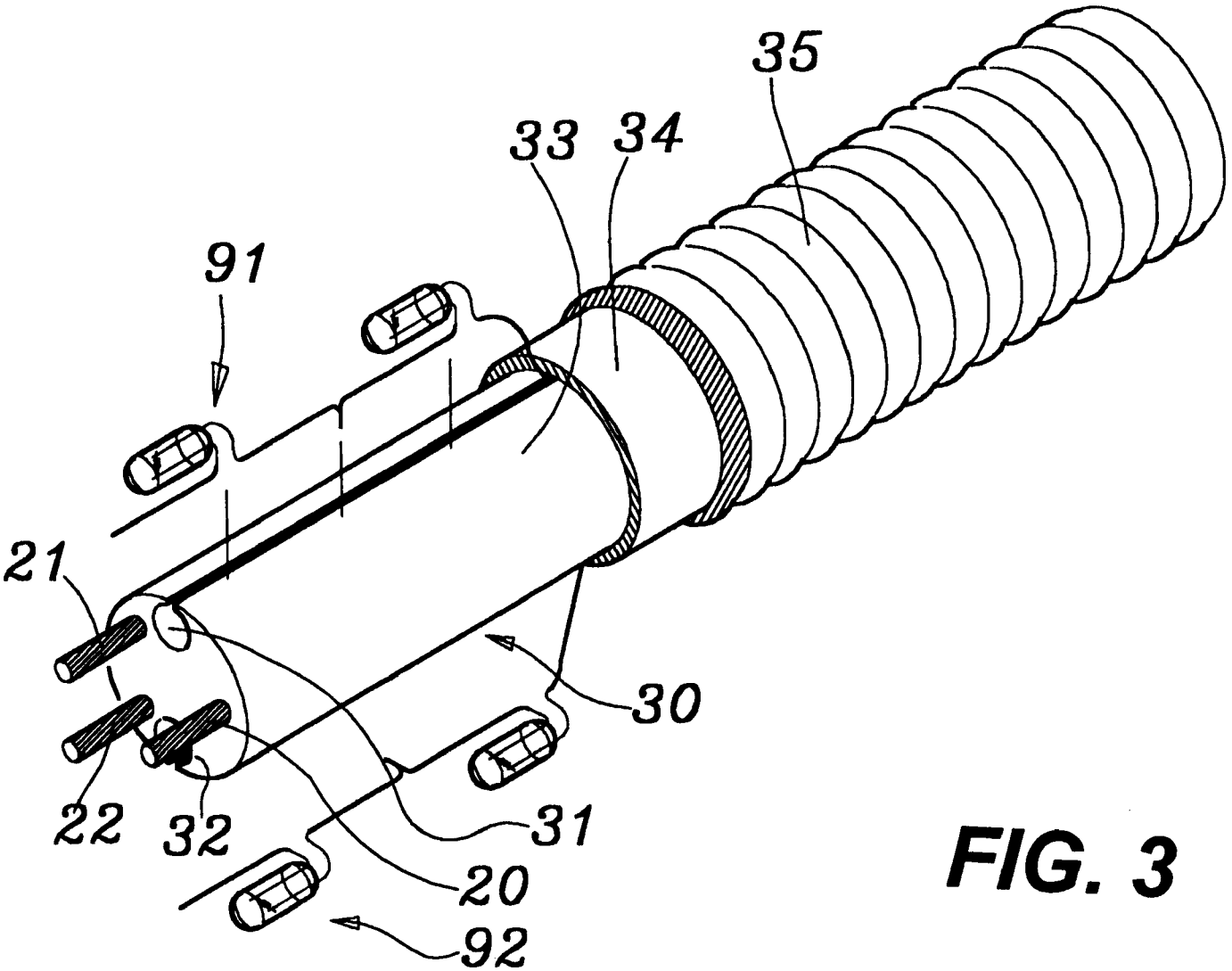
FIG. 3 is a schematic view showing a preferred embodiment of the present invention using two lamp strings.
Figure 4B:
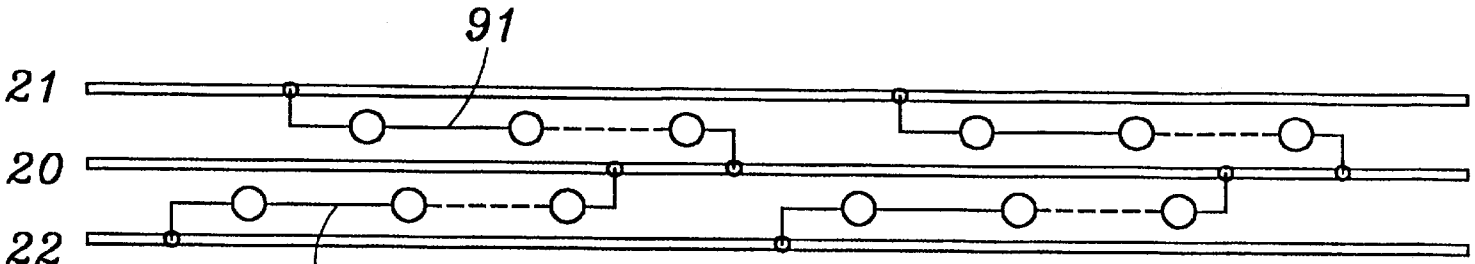
FIG. 4B is a schematic view showing connection of conductors thereof.
Figure 4:
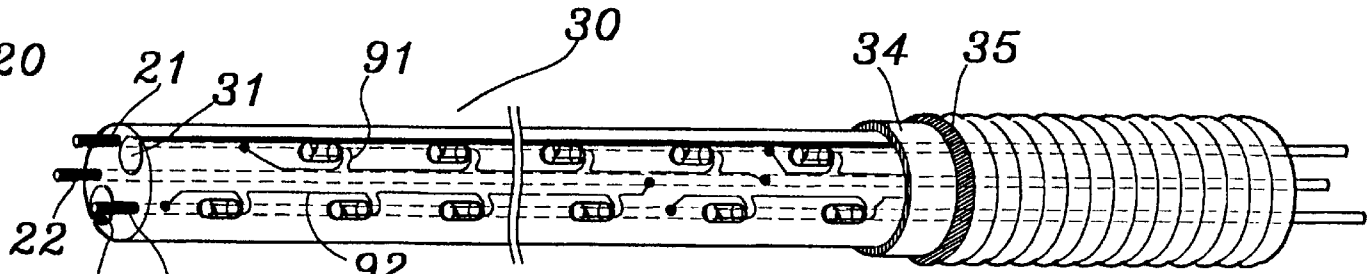
FIG. 4 is a structural schematic view for FIG. 3.

Referring to FIGS. 3, 4, the present invention also includes a transparent lamp pipe 30 which can be made of PVC material, the transparent lamp pipe 30 can be made to have axial elongated grooves 31, 32 in pursuance of the amount of the required lamp strings to be mounted therein. And a plurality of power conductors 20, 21 and 22 are synchronically positioned in the transparent lamp pipe 30 when in shaping.

Figure 4A:
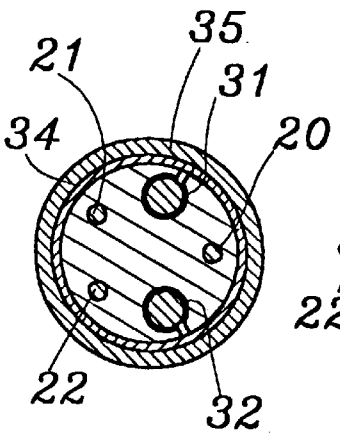

The above stated embodiment has two lamp strings 91, 92 in the transparent lamp pipe 30. Therefore, two axial elongated grooves 31, 32 are provided separated mutually 180 degrees apart, and the power conductors include a common power conductor 20 and two individual power conductors 21, 22. In this embodiment, as shown in FIGS. 4A and 4B, the common power conductor 20 is provided on one side of the two axial elongated grooves 31, 32, while the power conductors 21, 22 are on the other side. That is, the power conductors are arranged such that the common power conductor 20 and the power conductor 21 contain therebetween the corresponding axial elongated groove 31, while the common power conductor 20 and the power conductor 22 contain therebetween the corresponding axial elongated groove 32. Such arrangement of the power conductors 20, 21 and 22 in the transparent lamp pipe 30 renders the power conductors at a safe distance from the external periphery 33 of the transparent lamp pipe 30.

After the transparent lamp pipe 30 has the power conductors 20, 21 and 22 synchronically positioned therein in shaping, the two lamp strings 91, 92 can be respectively placed in the two axial elongated grooves 31, 32. Then a positioning layer 34 with a minimal diameter is formed on the external periphery of the transparent lamp pipe 30, and finally a transparent coating 35 of a minimal diameter covers thereon.

FIGS. 5, 5A and 5B show the fitting light of the present invention with three lamp strings 51, 52 and 53 therein. Three axial elongated grooves 301, 302 and 303 are disposed on a transparent lamp pipe 300 and are 120 degrees apart from one another. The lamp strings 51, 52 and 53 are respectively placed in their corresponding axial elongated grooves 301, 302 and 303. A plurality of power conductors 60, 61, 62 and 63 are synchronically positioned in the transparent lamp pipe 300 when in shaping as is the case stated before to render the power conductors 61, 62 and 63 to be disposed such that the common power conductor 60 and the power conductor 61 contain therebetween the corresponding axial elongated groove 301, the common power conductor 60 and the power conductor 62 contain therebetween the corresponding axial elongated groove 302, and the common power conductor 60 and the power conductor 63 contain therebetween the corresponding axial elongated groove 303. While the common power conductor 60 is located, in this embodiment, at the center of the transparent lamp pipe 300. The power conductors 61, 62, and 63 are disposed to be located each between two axial elongated grooves.

Figure 6B:
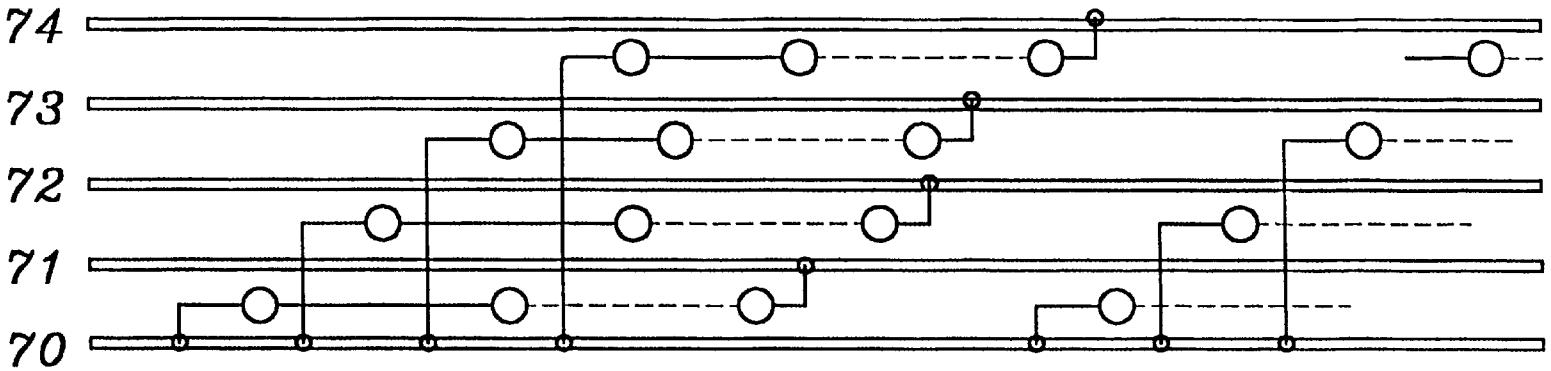
FIG. 6B is a schematic view showing connection of conductors thereof.
Figure 6:
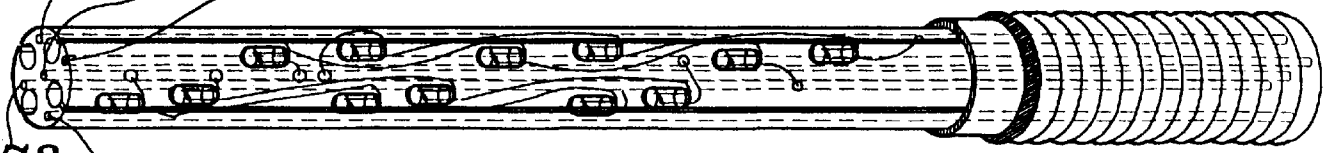
FIG. 6 is another structural schematic view showing the present invention with four lamp strings.
Figure 6A:
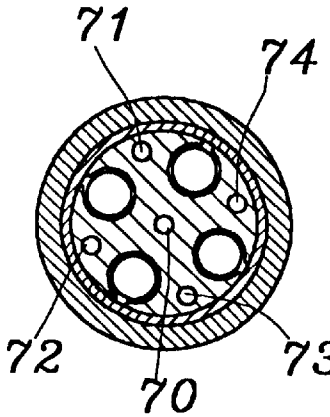

Similarly, FIGS. 6, 6A and 6B show the fitting light of the present invention with four lamp strings therein. A plurality of axial elongated grooves in corresponding number are disposed on a transparent lamp pipe and are 90 degrees apart from one another to respectively receive their corresponding lamp strings. A plurality of power conductors 70, 71, 72, 73 and 74 are synchronically positioned in the transparent lamp pipe when in shaping with the common power conductor 70 disposed at the center of the pipe, the power conductors 71, 72, 73 and 74 are disposed to be located each between two axial elongated grooves.

By virtue that each lamp string is received in a corresponding one of the axial elongated grooves to make manufacturing simple, and the power conductors are controlled to be kept away from the external periphery of the transparent lamp pipe to provide higher safety, and the whole external diameter of the fitting light can be effectively reduced when a plurality of lamp strings is used in the transparent lamp pipe, the present invention positively has its industrial value.

The embodiments mentioned above are only for illustrating the present invention, and not for giving any limitation to the scope of the present invention. It will be apparent to those skilled in this art that various modifications or changes can be made to the elements of the present invention without departing from the spirit and scope of this invention and fall within the scope of the appended claims and are intended to form part of this invention.

What is claimed is:

1. An improved structure of a fitting light, comprising:

a transparent lamp pipe integrally formed and covered with a transparent coating and having a plurality of power conductors, said power conductors including a common power conductor and a plurality of individual power conductors, said power conductors synchronously positioned in said transparent lamp pipe during shaping of said transparent lamp pipe; and, a plurality of axial elongated grooves in said transparent lamp pipe equidistantly spaced apart from one another and each of said groves receiving a lamp string, each axial elongated groove located between the common power conductor and one of said plurality of individual power conductors such that said common power conductor is not aligned with said plurality of power conductors.

2. An improved structure of a fitting light as claimed in claim 1, wherein said common power conductor is provided on one side of said axial elongated grooves, and said individual power conductors are provided on an opposite side of said axial elongated grooves.

3. An improved structure of a fitting light as claimed in claim 1, wherein said common power conductor is provided at a center of said transparent lamp pipe, and each of said axial elongated grooves is disposed between every two of said plurality of individual power conductors.

4. An improved structure of a fitting light, comprising:

a transparent lamp pipe integrally formed with a plurality of power conductors, said power conductors including a common power conductor and a plurality of individual power conductors, said power conductors synchronously positioned in said transparent lamp pipe during shaping of said transparent lamp pipe;

a plurality of axial elongated grooves in said transparent lamp pipe, said plurality of axial elongated grooves disposed on said transparent lamp pipe and are equidistantly spaced apart from one another and adapted to each receive a lamp string, each axial elongated groove being located between the common power conductor and one of said plurality of individual power conductors; and, a positioning layer having a minimal diameter formed on an external periphery of said transparent lamp pipe with a cover of a transparent coating having a minimal diameter on said positioning layer.

* * * * *